US005167755A

United States Patent [19]

Zodrow et al.

[11] Patent Number: 5,167,755

[45] Date of Patent: Dec. 1, 1992

[54] ADHESIVE SCRAPER WHICH CAN BE ADJUSTED IN RELATION TO AN ADHESIVE ROLLER IN A LABELLING MACHINE

[75] Inventors: Rudolf Zodrow; Werner Nitschke, both of Düsseldorf, Fed. Rep. of Germany

[73] Assignee: Holstein und Kappert AG, Dortmund, Fed. Rep. of Germany

[21] Appl. No.: 716,721

[22] Filed: Jun. 17, 1991

[30] Foreign Application Priority Data

Jun. 18, 1990 [DE] Fed. Rep. of Germany ..... 4019409
Jan. 24, 1991 [DE] Fed. Rep. of Germany ..... 4102022

[51] Int. Cl.[5] ..... B65C 11/04

[52] U.S. Cl. ..... 156/578; 118/258; 118/261

[58] Field of Search ..... 118/258, 261, 262, 413; 156/568, 578

[56] References Cited

U.S. PATENT DOCUMENTS 4,279,687 7/1981 Buchholz et al. ..... 156/568
4,906,335 3/1990 Goodnow et al. ..... 118/261 X

*Primary Examiner*—David A. Simmons
*Assistant Examiner*—William J. Matney, Jr.
*Attorney, Agent, or Firm*—Nils H. Ljungman

[57] ABSTRACT

A device for adjusting the size of the gap between an adhesive scraper of a labelling machine and an adhesive roller of the labelling machine. The device includes at least two independently controllable actuators that adjust the gap to different sizes from one another. The actuators may take the form of hydraulically or pneumatically controlled pistons and cylinders.

20 Claims, 11 Drawing Sheets

ADHESIVE SCRAPER WHICH CAN BE ADJUSTED IN RELATION TO AN ADHESIVE ROLLER IN A LABELLING MACHINE

BACKGROUND OF THE INVENTION

1. Field of the Invention

The present invention relates to an adhesive scraper that can be adjusted in relation to an adhesive roller in a labelling machine, wherein the adhesive scraper is mounted with a beam, or carrier or support, on a shaft so that it can pivot. The beam is spring-loaded in the direction of a stop that is permanently fastened to the frame of the labelling machine and set for a minimum gap width of the adhesive scraper in relation to the adhesive roller. Parallel to this stop, there is an additional, adjustable stop permanently fastened to the frame on which the beam can be supported by an actuator with a constant actuator travel, or in other words, a preselected distance of actuator travel.

2. Background Information

Bottle labelling machines that may be encountered in actual practice have an adhesive scraper that may be similar to the type described above, so that the thickness of the layer of adhesive on the adhesive roller can be regulated as a function of the type of label used for the labelling. The adjustment of the adhesive scraper into a, practically, no-pressure contact with the adhesive roller is used when the labelling machine is at idle and when no more adhesive is being removed from the adhesive roller for the labels, to keep the adhesive roller free of adhesive.

In actual practice, however, it has been found that the adjustment of the gap width that is optimal for a specified label is a function of the speed of the labelling machine. With high-speed labelling machines, the accumulation of adhesive in front of the adhesive scraper causes a flattening of the elastic jacket of the adhesive roller, with the result that the gap width is increased in comparison to the conditions that exist on a labelling machine operating at a slower speed. That leads to adhesive films of different thicknesses on the adhesive roller. That, in turn, results in adhesive application conditions at the different speeds that are not always optimal.

OBJECT OF THE INVENTION

An object of the present invention is, therefore, to provide an adjustable adhesive scraper of the type described above that makes it possible to change the position of the adhesive scraper during operation.

SUMMARY OF THE INVENTION

This object of the present invention is achieved by a scraper or blade actuator that is designed as an actuator apparatus that may act in several stages, such as two stages.

The actuator apparatus can be a cylinder-piston unit with actuator cylinders connected in series wherein, preferably, one actuator cylinder acts with its piston rod on the piston and/or cylinder of another actuator cylinder that has a longer stroke than the first actuator cylinder. The actuator apparatus may, also, comprise a cylinder-piston unit with actuator cylinders oriented parallel to one another wherein the strokes of the actuators are of different lengths. Additionally, a combination of both of these cylinder-piston units may be employed. In other words, two sets of serially connected pistons and cylinders may be oriented such that one set is parallel to the other set.

Because of the multi-stage or two-stage nature of the actuator apparatus, it is possible, during operation, to set the adhesive blade or scraper parts to different operating positions to compensate for the flattening of the elastic adhesive roller as a function of the speed of the labelling machine. For example, at a low speed, the adhesive scraper is placed in a first position. If the machine is then changed to a higher speed, the actuator apparatus moves the adhesive blade or scraper closer to the adhesive roller so that the adhesive gap at high speed is essentially the same as the adhesive gap at low speed.

If the actuator apparatus has two cylinder-piston units connected in parallel, and if each unit has actuator cylinders with different strokes connected in series, the actuator apparatus provides five possible adjustments; namely the position of the adhesive scraper in approximately no-pressure contact with the adhesive roller and four additional positions each providing different gap widths. In other words, if the actuator apparatus comprises two, parallelly oriented units, and if each unit includes two serially connected pistons and associated cylinders wherein each piston and associated cylinder has a different stroke length, then five different blade positions may be possible.

It is also sometimes necessary to set different thicknesses of the adhesive layer on the adhesive roller if different labels are to be processed simultaneously. It has been proposed that this be accomplished by a multipart adhesive scraper with each part having a separate actuator. With this arrangement, both actuators must be operated in each case, both for identical and for different gap widths. To reduce the amount of equipment required, an additional embodiment of the present invention proposes an adhesive scraper divided into two parts. Both parts are mounted on the shaft, one above the other, so that they can pivot. Two beams, that support the two scraper parts, are connected to one another by a single-thrust slaving device so that when one actuator is activated, the beam corresponding to that actuator drives the other one with it. The slaving device can be designed in a simple manner with one driver mounted on a beam and an abutment mounted on the other beam.

The present invention can be realized both with an idle, or return stroke, and without an idle, or return stroke. Without an idle, or return, stroke, the activation of one actuator leads to identical gap width settings of the scraper parts on the adhesive roller. With an idle, or return, stroke such a stroke leads to different gap widths. In both cases, however, the slaving device does not prevent the independent activation of the two actuators to, thereby, set different gap widths. The flexibility of the adhesive scraper for making adjustments to different gap widths can be further improved by providing the slaving device with an adjustable idle, or return, stroke.

For maintenance purposes, it is advantageous if the two beams or supports are coupled to one another by means of a double thrust slaving device when such an idle, or return, stroke is provided, so that the slaving device does not respond in the adjustment range of the actuators. In such a case, there should be a hand lever, on one beam, that may be employed to pivot the entire scraper unit back out of the operating position or out of the idle, or return, position and into the service position.

Such a double thrust slaving device, however, can also be used as an alternative to the single thrust slaving device. Such a double thrust slaving device makes it possible to optionally perform adjustments of both parts of the scraper with one or the other actuator, would be possible with a single thrust driver on only one of the two actuators.

In accordance with one embodiment of the present invention, the spring loading of each stop set for the minimum gap width of the corresponding adhesive scraper part can be achieved by means of a thrust piece acting on a wedge surface.

One aspect of the invention resides broadly in a labelling machine comprising: a labelling station; apparatus for supplying labels to the labelling station; apparatus for supplying objects to be labelled to the labelling station; the labelling station having an adhesive application roller; apparatus for supplying adhesive to the adhesive application roller; apparatus for variably adjusting a thickness of adhesive on the adhesive application roller; the means for variably adjusting a thickness of adhesive on the adhesive application roller comprising: blade apparatus for adjusting the thickness of adhesive on the adhesive application roller; positioning apparatus for moving the blade apparatus between a plurality of positions adjacent the adhesive application roller; the blade apparatus and the adhesive application roller to define a gap therebetween at each of the position of the blade apparatus; the blade apparatus being configured to form a thickness of adhesive on the adhesive application roller corresponding to each the gap; and each thickness of adhesive corresponding to each the gap being different from each other thickness of adhesive corresponding to each other in gap.

Another aspect of the invention resides broadly in an apparatus for variably adjusting a thickness of adhesive on an adhesive application roller of a labelling machine, the apparatus comprising: blade apparatus for adjusting the thickness of an adhesive on the adhesive application roller; positioning apparatus for moving the blade apparatus between a plurality of positions adjacent the adhesive application roller; the blade apparatus and the adhesive application roller to define a gap therebetween at each the position of the blade apparatus; the blade apparatus being configured to form a thickness of adhesive on the adhesive application roller corresponding to each gap; and each thickness of adhesive corresponding to each gap being different from each other thickness of adhesive corresponding to each other the gap.

A final aspect of the invention resides broadly in an apparatus for variably adjusting the thickness of adhesive on an adhesive application roller of a labelling machine, the apparatus comprising: apparatus for adjusting the thickness of adhesive on the adhesive application roller; apparatus for variably controlling the apparatus for adjusting the thickness of adhesive on the adhesive application roller to a plurality of positions adjacent the adhesive application roller; the apparatus for adjusting the thickness of adhesive on the adhesive application roller and the adhesive application roller defining a gap therebetween at each position of the apparatus for controlling the thickness of adhesive on the adhesive application roller; the apparatus for adjusting the thickness of adhesive on the adhesive application roller being configured to form a thickness of adhesive on the adhesive application roller corresponding to each gap; and each thickness of adhesive corresponding to each gap being different from each other thickness of adhesive corresponding to each other said gap.

BRIEF DESCRIPTION OF THE DRAWINGS

The following Description of the Preferred Embodiments may be better understood when taken in conjunction with the appended drawings in which.

Figure 5:
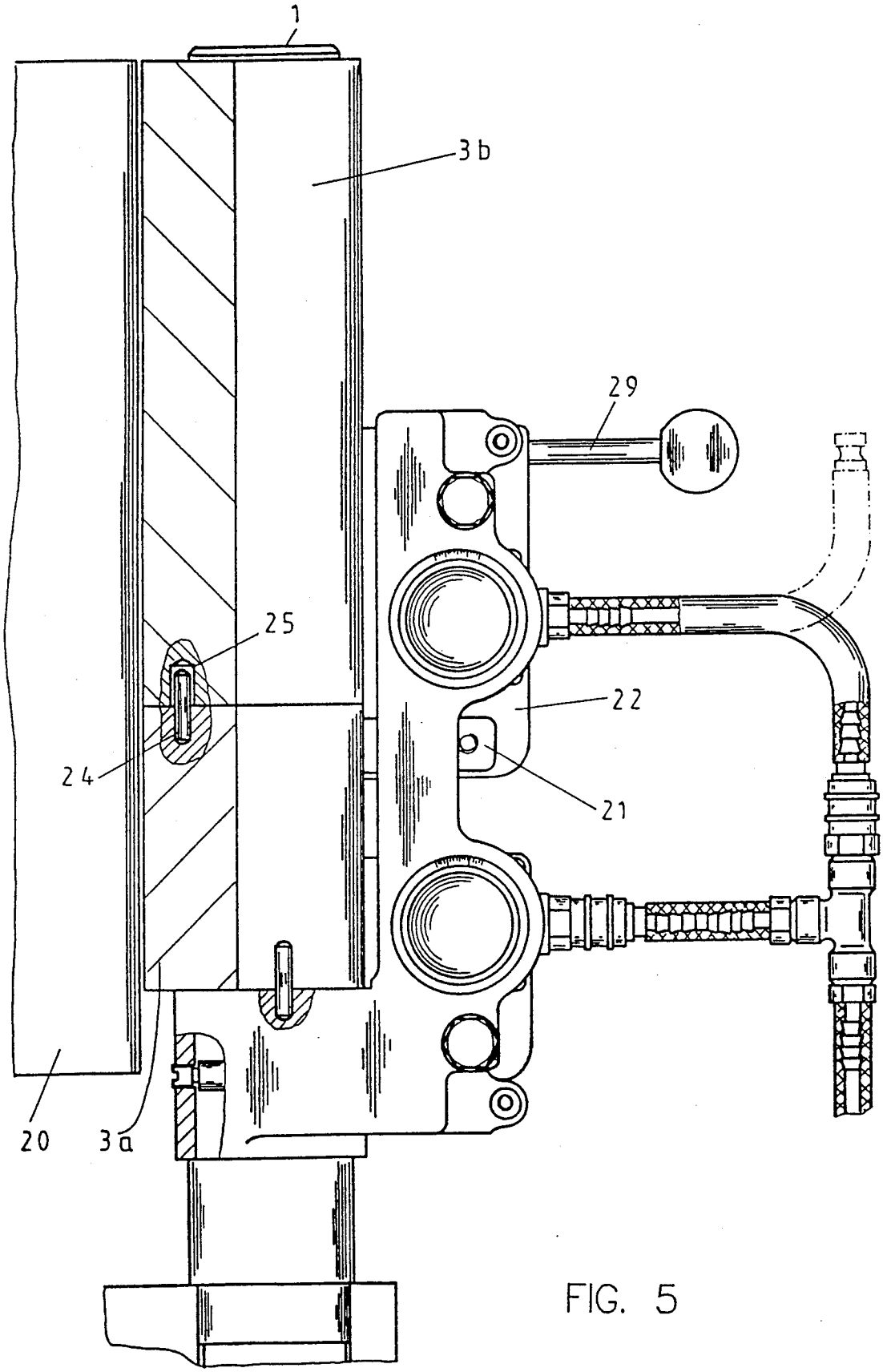
Figure 6:
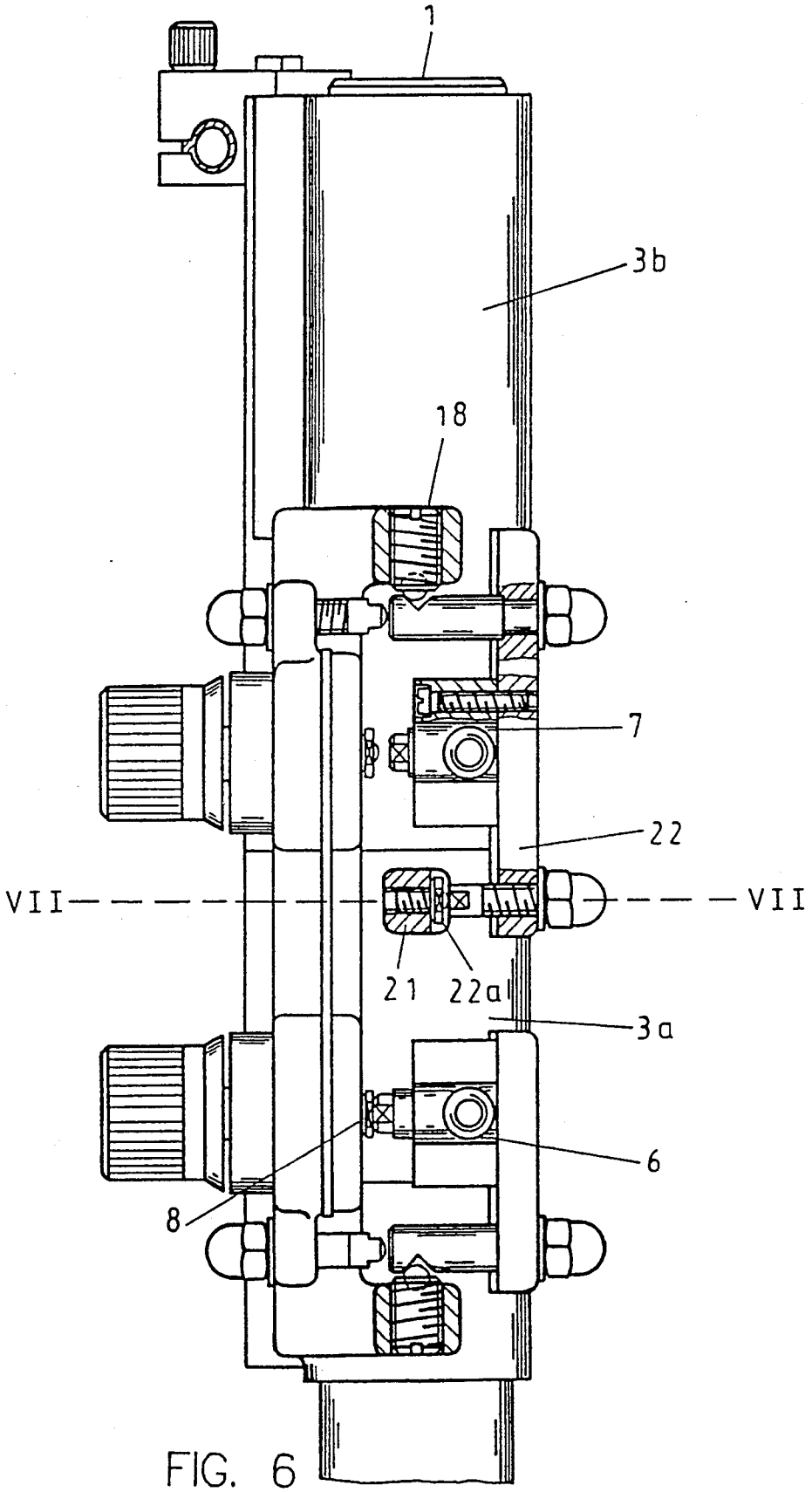
Figure 7:
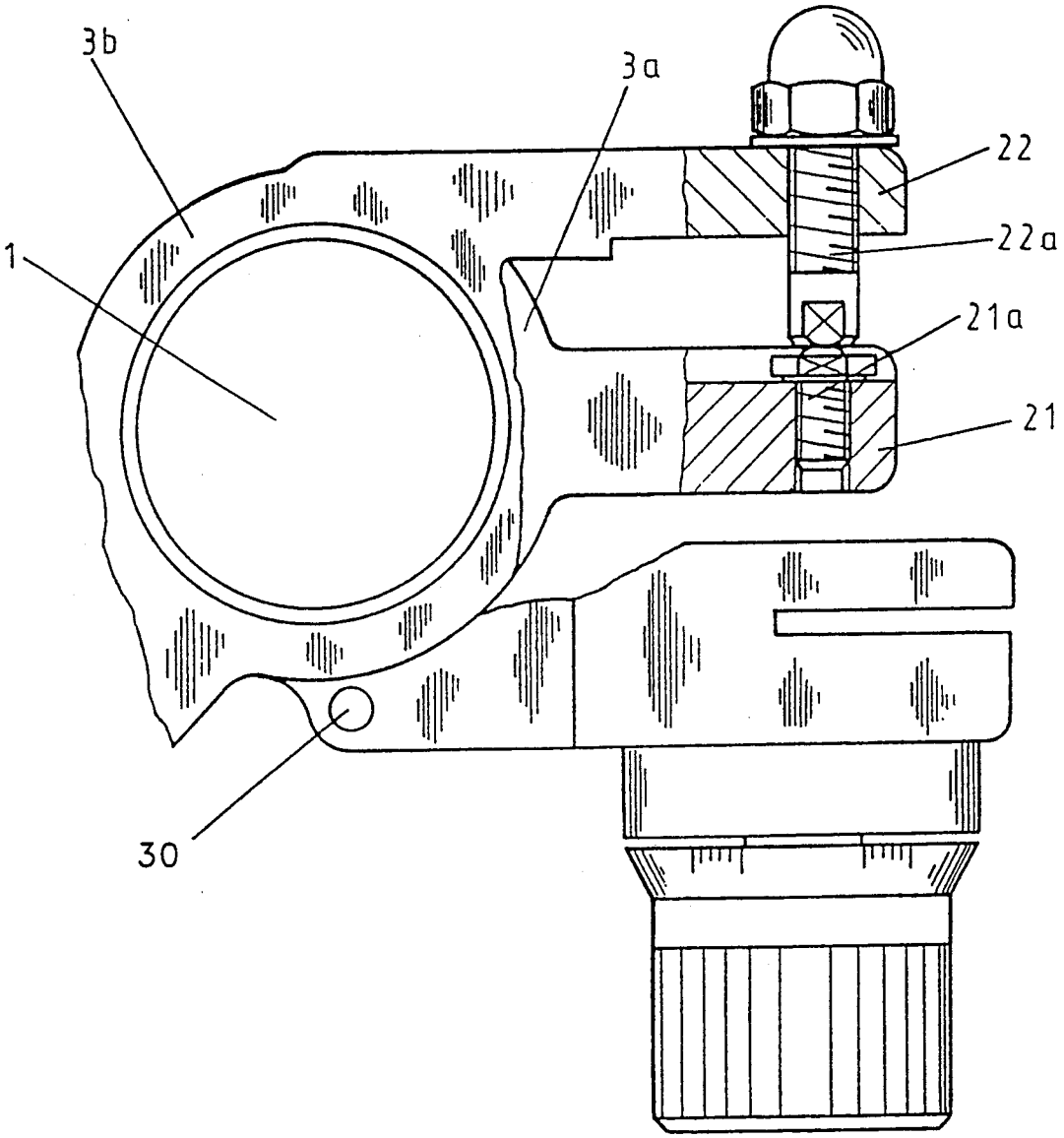

FIGS. **4*a*–4*c*** are side elevational views, partially in cross section, of another embodiment of the actuator apparatus of the present invention;

FIG. 5 is a top view of an actuator apparatus for a two-piece adhesive scraper;

FIG. 6 is a front elevational view of an actuator apparatus for the adhesive scraper shown in FIG. 5; and FIG. 7 is a side elevational view of the actuator apparatus shown in FIG. 6, taken along line VII—VII of FIG. 6.

DESCRIPTION OF THE PREFERRED EMBODIMENTS

The present invention may be employed in labelling machine 100. Labelling machine 100 includes labelling station 102, object supply 104, adhesive supply 106, controller 108 and label supply 110.

Beam 3, that supports one-piece adhesive blade means or scraper 2, is mounted on shaft 1 so that it can rotate. Beam 3 may be a carrier or a support. Scraper or blade means 2 may be a doctor or a doctor blade. Beam 3 supports, on beams or lever arms 4 and 5, actuators or positioning means 6 and 7. Actuators 6 and 7 may be in the form of hydraulically or pneumatically operated actuator pistons and/or cylinders that function independently of one another and, in the extended position, are in contact with adjustable stops 8 and 9. Actuators 6 and 7 may, also, be electrically controlled solenoids.

Stops 8 and 9, that can be adjusted by means of control knobs **8*a* and 9*a*, respectively, are supported by mounting 10, which is permanently fastened to the frame underneath adhesive scraper 2 on shaft 1 and adjusted with screw 11. In addition to stops 8 and 9, set screws 13 and 14, that are located on mounting 10, form stops for bolts 15 and 16 located next to actuators 6 and 7 on lever arms or beams 4 and 5, so that with them, when actuator cylinders 8 and 9 are not activated for idle operation, lever arms 4 and 5 can be pivoted to the smallest gap width, in which case adhesive scraper 2 is in practically no-pressure contact against adhesive roller 19. For this purpose, spheres of spring-loaded thrust pieces 17 and 18 are engaged in wedge-shaped notches 15*a* and 16*a* on bolts 15 and 16 so that there is an introduction of force counter to the direction of force of the actuators 6 and 7. In this manner, after the pressure is removed, beam 3 is automatically pivoted back into the idle position to stops 8 and 9. Moreover, the force generated in this manner has a stabilizing effect on the discontinuous force developed between adhesive scraper 2 and adhesive roller 19** that is caused by the uneven thickness of the adhesive layer.

By way of further explanation, thrust pieces 17 and 18 are spring-loaded devices that are biased toward the apex of their respective notch 15*a* or 16*a*. When lever arms 4 and 5 are pivoted from their initial position, the angled walls that define notches 15*a* and 16*a* apply a component of force against their respective thrust piece 17 or 18 causing thrust pieces 17 and 18 to move opposite their biased direction and at least partially out of notches 15*a* and 16*a*. However, the spring biasing of thrust pieces 17 and 18, wherein thrust pieces 17 and 18 are biased toward the apex of their respective notch 15*a* or 16*a*, causes thrust pieces 17 and 18 to apply a force against the angled walls that define notches 15*a* and 16*a*. A component of that spring biasing force is applied in a direction that tends to pivot lever arms 4 and 5 back to their initial position wherein thrust pieces 17 and 18 are positioned and generally centered within their respective notch 15*a* or 16*a*.

Actuators 6 and 7 may be designed as pneumatic or hydraulic actuator cylinders or may be electrically controlled solenoids. Actuators 6 and 7 may be designed for strokes of different lengths so that when actuator 6 is actuated or pressurized, adhesive scraper, or blade, 2 is set to a first gap width, and when actuator 7 is activated or pressurized, adhesive scraper 2 is set to a second, different gap width. The same result can also be achieved with strokes of identical lengths by different settings of stops 8 and 9.

Figure 1:
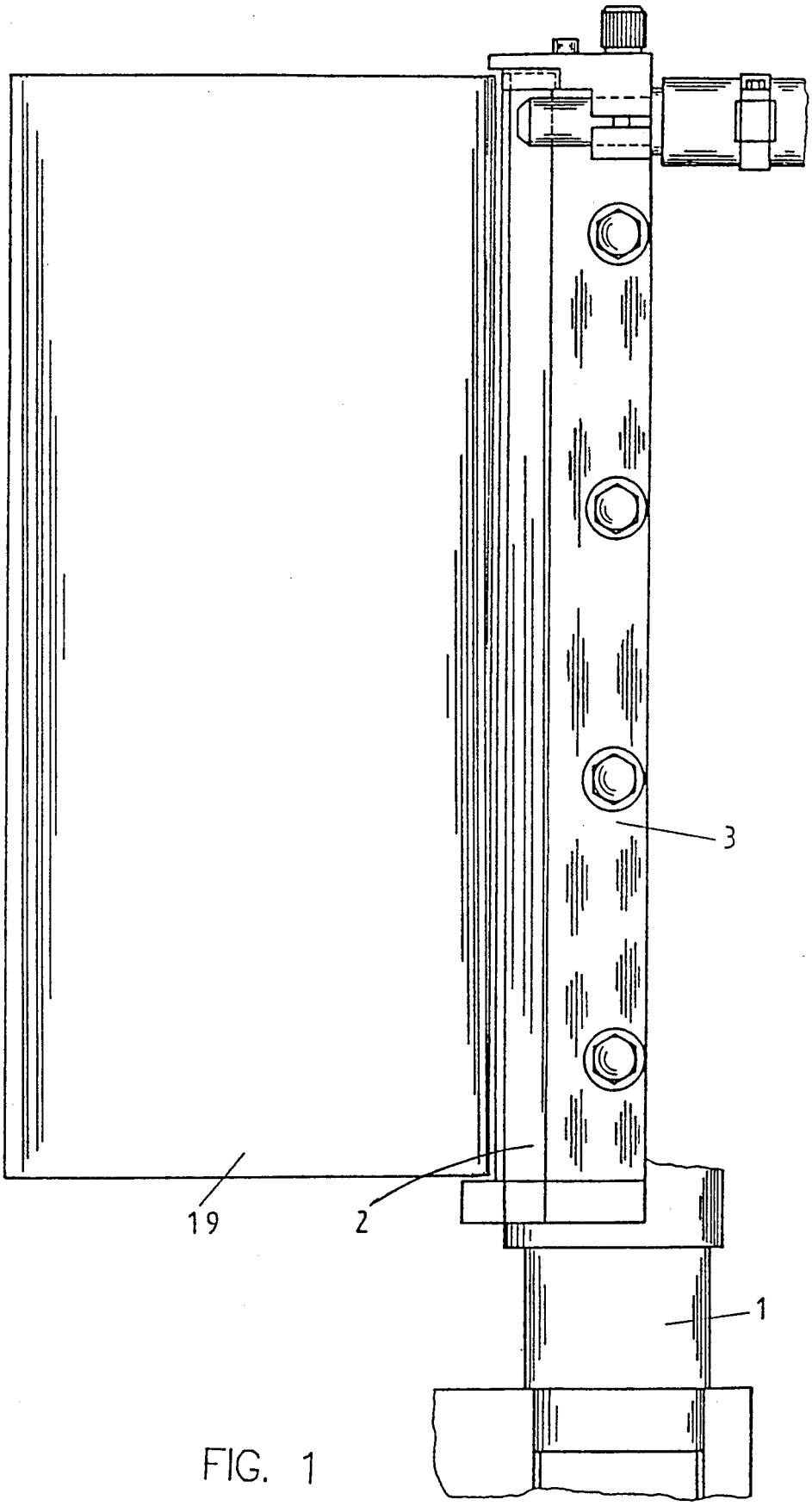
FIG. 1 is a top view of a one-piece adhesive scraper of the present invention and an adhesive roller.
Figure 1A:
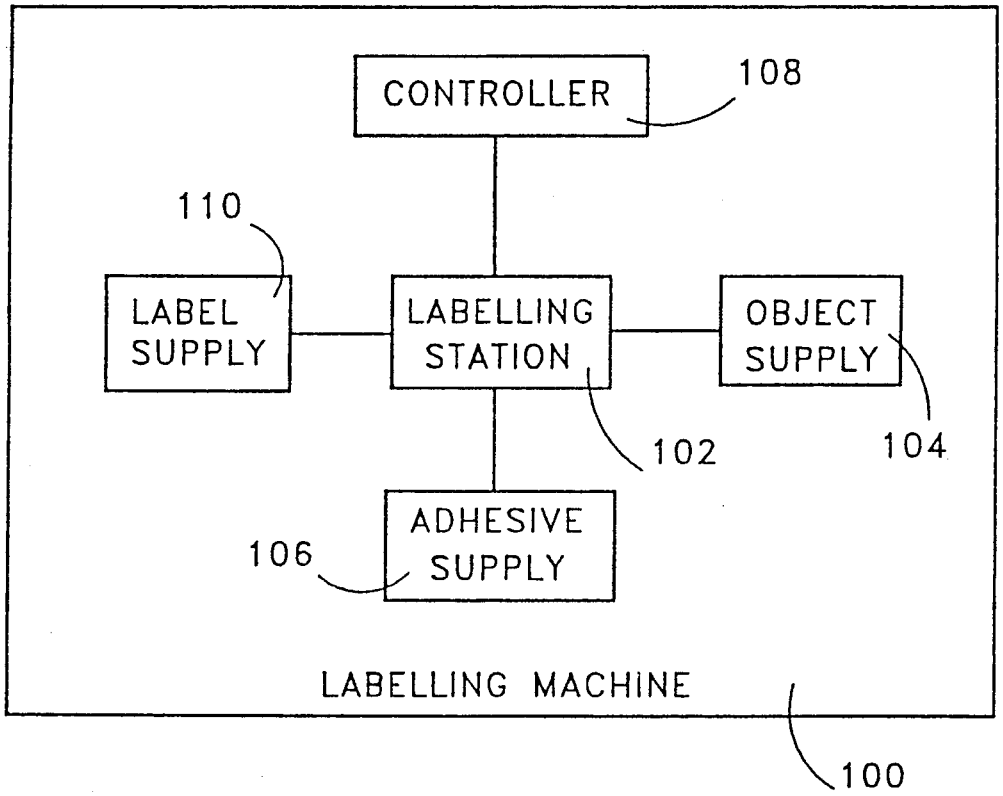
FIG. 1A is a block diagram showing various components of a labelling machine.
Figure 2:
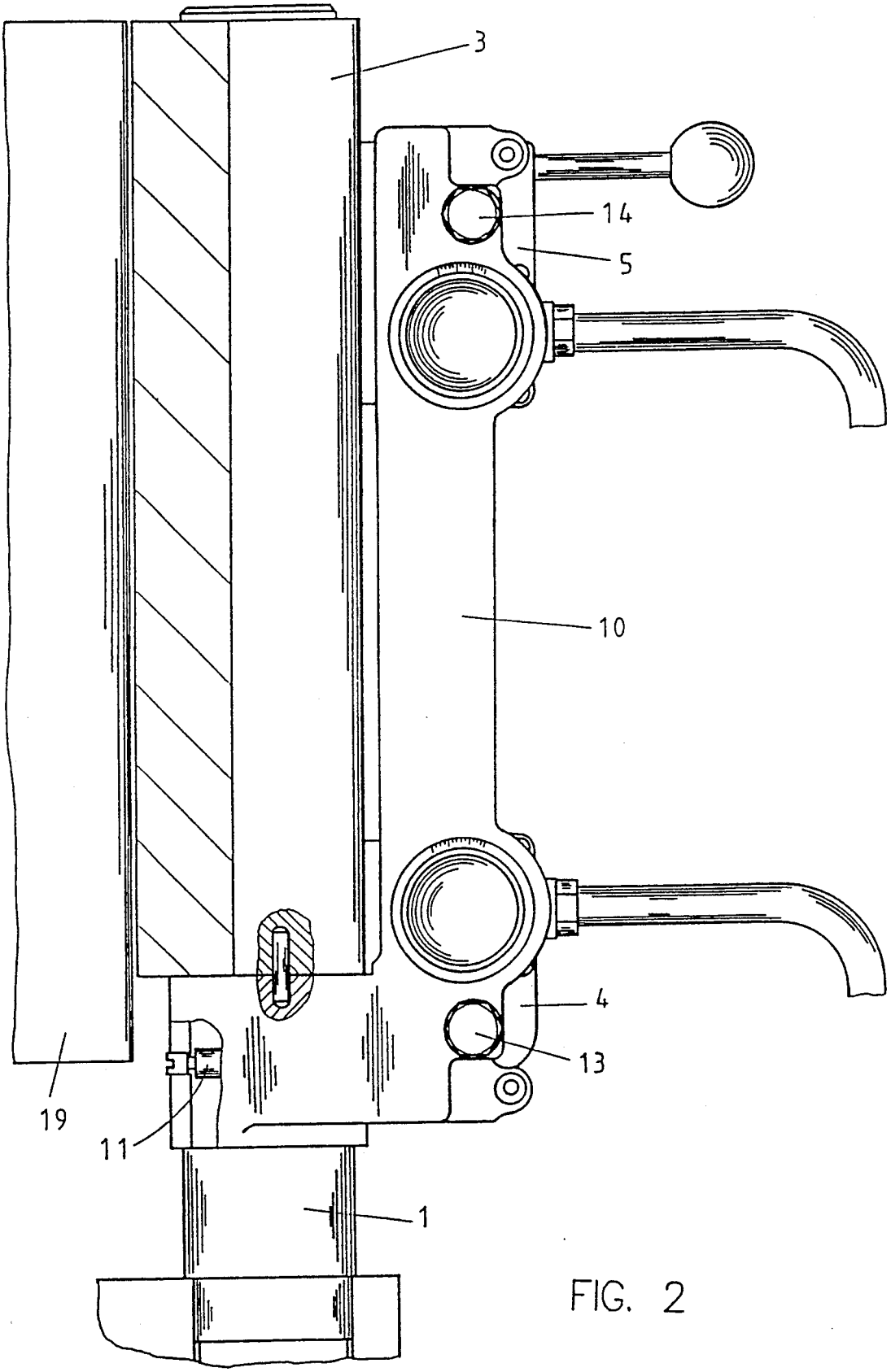
FIG. 2 is a top view of an actuator apparatus, of the present invention, for the adhesive scraper shown in FIG. 1.
Figure 3:
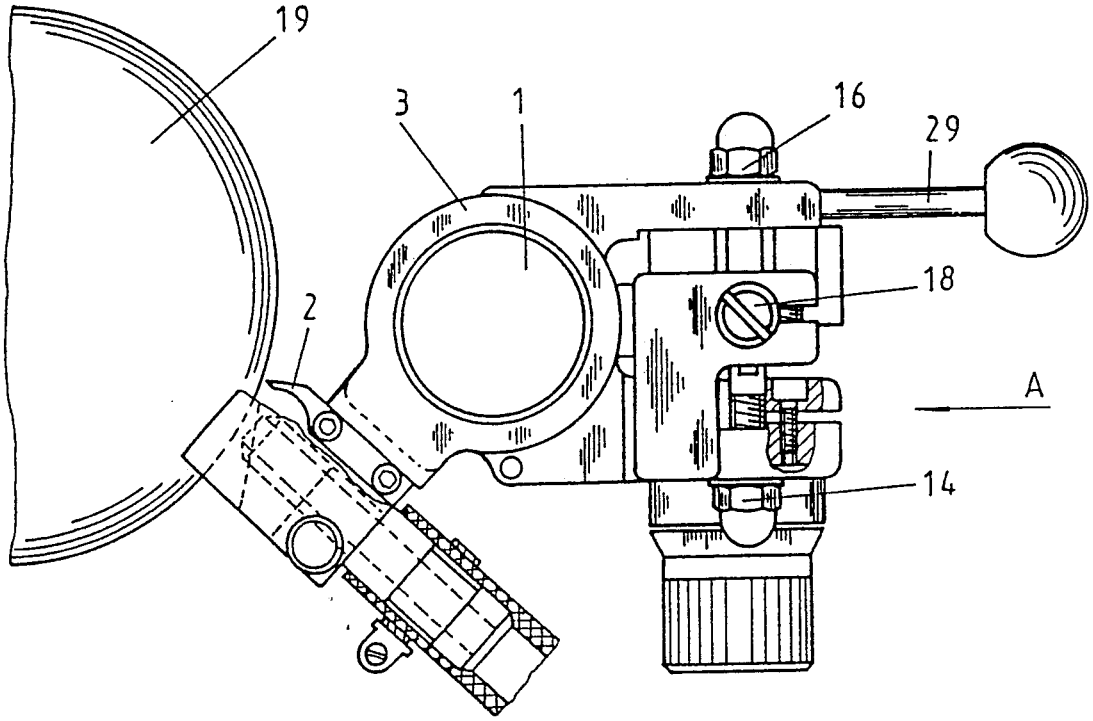
FIG. 3 is a side elevational view, partially in cross section, of the adhesive scraper and the adhesive roller shown in FIG. 1 and the actuator apparatus shown in FIG. 2.
Figure 4:
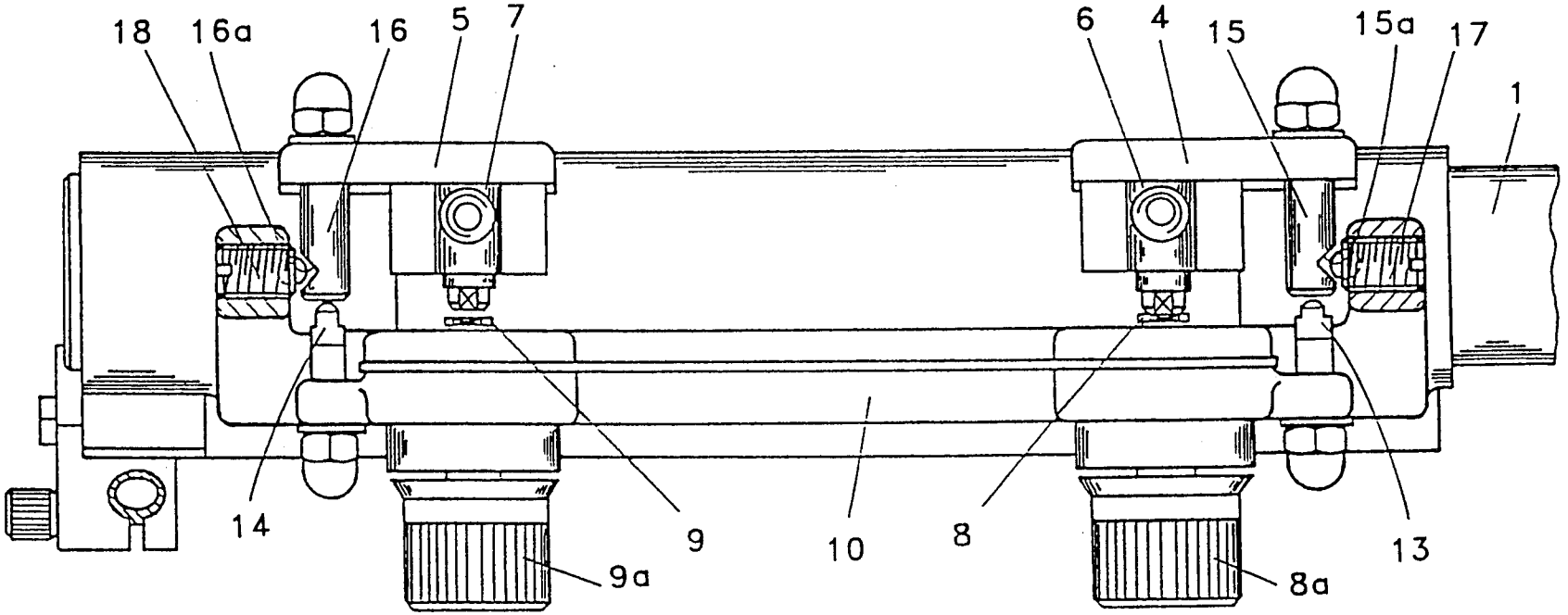
FIG. 4 is a front elevational view of the actuator apparatus for the adhesive scraper shown in FIG. 2, taken in the direction of arrow A of FIG. 3.
Figure 4A:
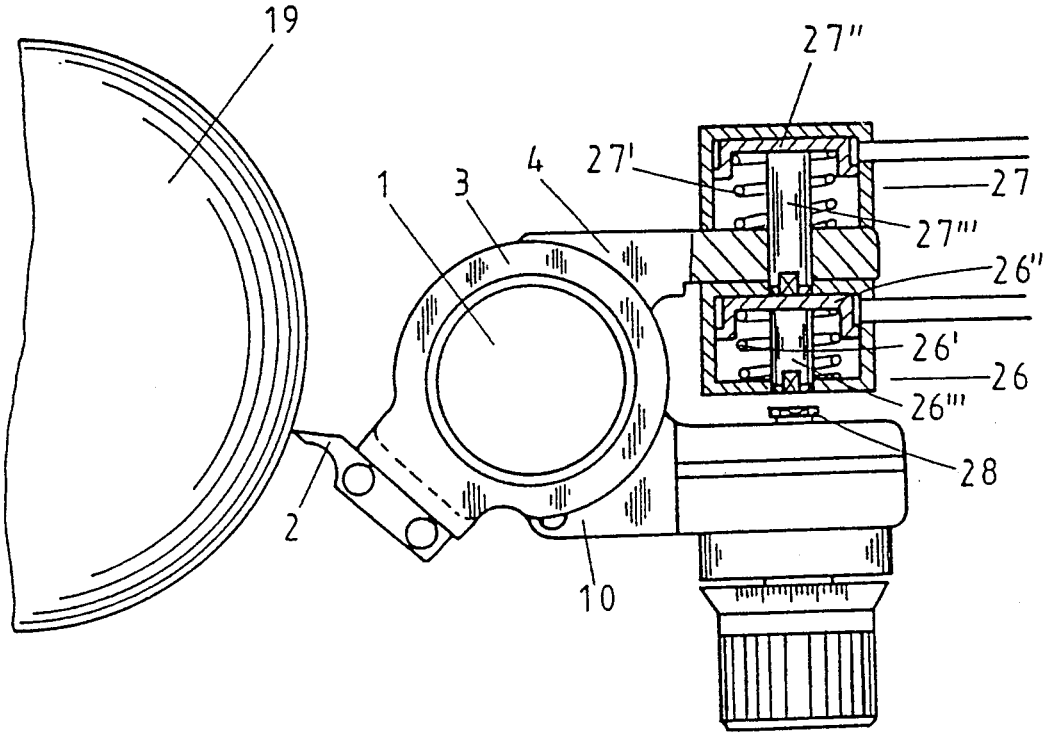
Figure 4B:
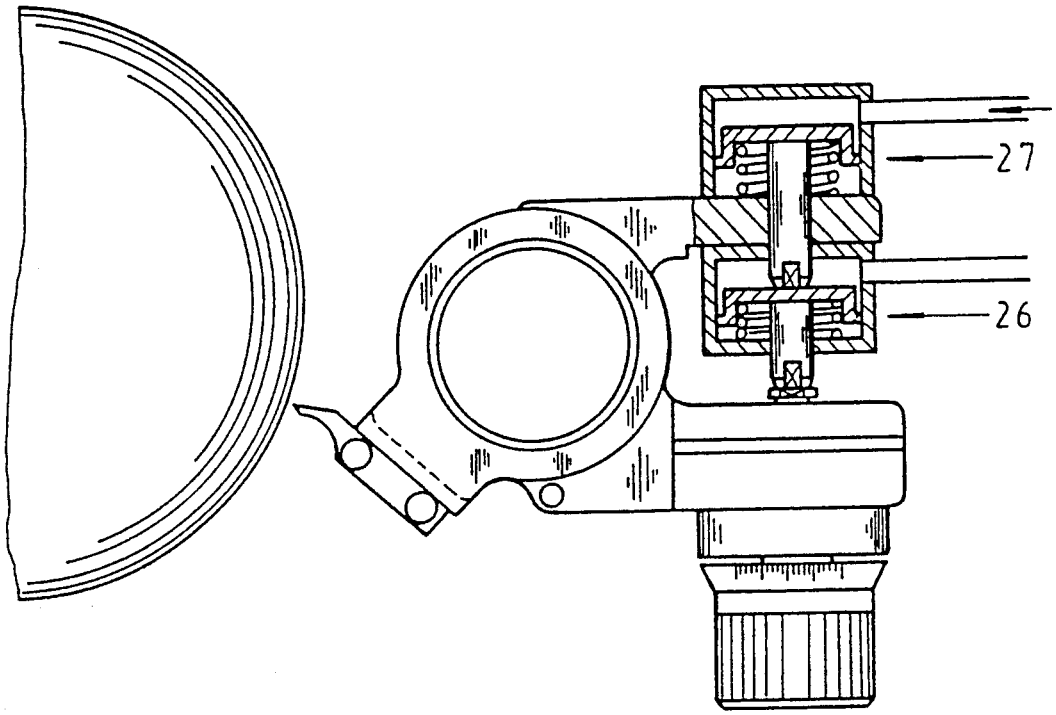
Figure 4C:
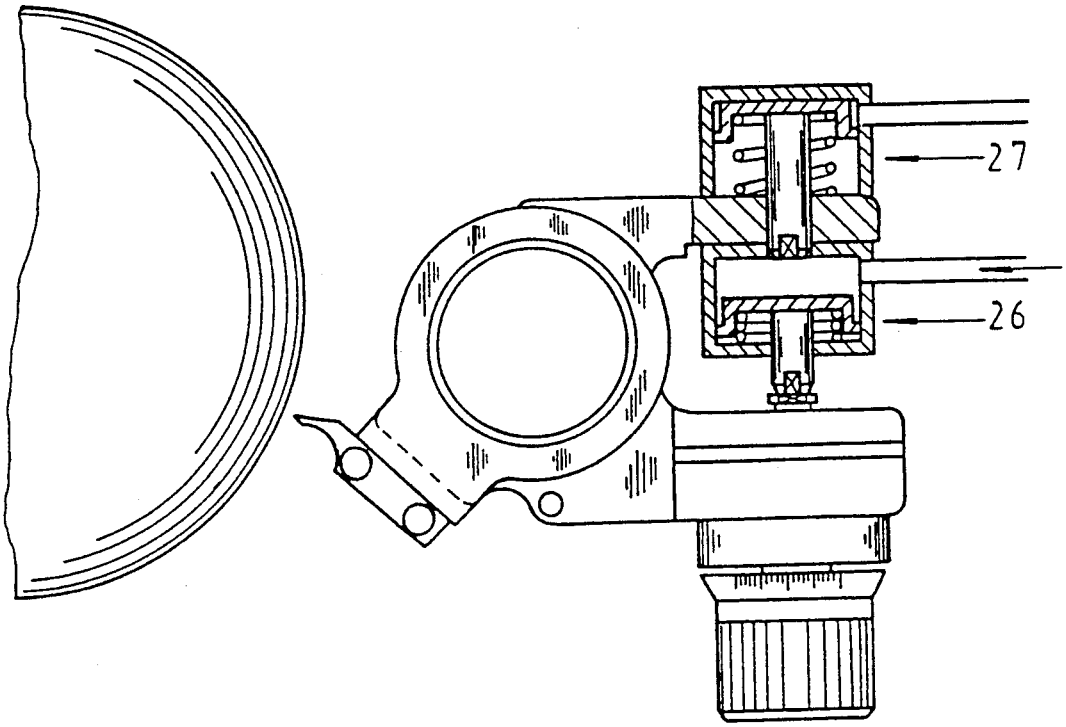

Alternatively, instead of two actuators 6 and 7 operating in parallel, there can also be two or more actuators, or positioning means, 26 and 27 located in series, one behind the other, as shown in FIGS. 4*a*–4*c*. Actuators 26 and 27 are designed as actuator cylinders, like actuators 6 and 7 of the above described embodiment of the present invention and can be activated or pressurized independently of one another. Actuator cylinders 26 and 27 have pistons 26″ and 27″, respectively, supported on springs 26′ and 27′. Piston rod 27‴ of actuator cylinder 27 acts on piston 26″ of actuator cylinder 26, while piston rod 26‴ forms stop 28 of the actuator. Actuator cylinders 26 and 27 are designed so that actuator cylinder 27 has a longer stroke than actuator cylinder 26.

Actuator cylinders 26 and 27, when connected in series, can also replace each of actuator cylinders 6 and 7 of the previously described embodiment of the present invention, in which case actuator cylinder 26 and actuator cylinder 27 have different stroke lengths. Such a configuration increases the number of possible settings or positions to which scraper 2 can be set. In other words, by replacing two single and parallel operating actuators with two parallel sets of serially connected actuators, the number of possible settings or positions to which scraper 2 can be set can be increased. In such case each of the sets if actuators would include a plurality of serially connected pistons and associated cylinders.

Lever 29 is fastened to beam 3 to bring adhesive scraper 2 from its idle position into a pivoted out position for cleaning. Mounting 10 has stop pin 30 to prevent adhesive scraper 2 from pivoting out too far when lever 29 is activated.

The embodiment of the present invention shown in FIGS. 5–7 differs from the embodiments described above in that, essentially, the adhesive scraper consists of two scraper parts located one above the other. Each scraper part has an associated beam or support or carrier 3*a* or 3*b*. Beams 3*a* and 3*b* are coupled by means of a single thrust and/or double thrust slaving device comprising elements 21–22*a*, 24 and 25 as described below. The description of the embodiment of the present invention provided below is limited to, generally, the differences of this embodiment from the other embodiments, since the embodiment of the present invention with the divided adhesive scraper may be fully understood therefrom.

Lever 21, installed on beam 3*a*, forms a single thrust driver, having an end that includes adjustable abutment 21*a*. Adjustment screw 22*a* is fastened to lever arm 22 of beam 3*b*. The driver, that is lever 21, and lever arm 22 form a single thrust slaving device between the parts of the adhesive scraper. With adjustment screw 22*a* and abutment 21*a*, the idle stroke and thus the subsequent relative rotation between beams 3*a* and 3*b* can be adjusted and thus, also, the scraper parts and also the gap width between adhesive roller 20 and the scraper parts. That is to say that the separation between adjustment screw 22*a* and abutment 21*a* determines the distance that lever arm 21 moves before it engages and moves lever 22. This separation is known as the "idle stroke."

The function of the single thrust slaving device comprising elements 21–22*a* is as follows. If, when actuator 7 is deactivated or depressurized, actuator 6 is activated or pressurized and, thus, its associated piston is extended from its associated cylinder, actuator 6 pivots beam 3*a* while supported against adjustable stop 8 and, thus also, pivots lever 21 whereby lever 21 acts as the driver. As soon as lever 21, with abutment 21*a*, encounters adjustment screw 22*a*, beam 3*b* is also pivoted by means of lever arm 22. The gap width between the adhesive scraper parts and adhesive roller 20 is a function of this idle stroke setting. Then, by activation or pressurization of actuator 7, beam 3*b* can be pivoted further. Two extreme cases are possible. In one case when the idle stroke is zero, beam 3*b* and lever 21 and lever arm 22 are simultaneously driven. In the other case, when the idle stroke is at a maximum, lever arm 22 is not driven by lever 21 at all. In the latter case, the pivoting movements of the two parts of the adhesive scraper are completely independent of one another.

FIG. 5 also shows a double thrust slaving apparatus. It consists of pin 24, that is rigidly inserted into beam 3*a*, and hole 25 in beam 3*b*, into which pin 24 is engaged with, possibly, some play. The size of hole 25 is determined so that a limited independent adjustment of the scraper parts is possible. This slaving function corresponds to the single thrust slaving apparatus, but in this case, the joint movement can be executed either by actuator 7 or actuator 6. That is to say that the double thrust slaving device connects together, with some play, the two scraper parts so that either scraper part may be directly driven and the directly driven scraper part will drive the other scraper part. Double thrust slaving apparatus 24 and 25 can be used in conjunction with slaving devices 21–22*a*. In such a case, it is used to drive the lower beam 3*a* with the lower scraper part, if, by means of lever 2*a* fastened on beam 3*b* of the upper scraper part, both parts of the scraper are pivoted away from adhesive roller 20, e.g. for cleaning purposes, and are then to be pivoted back into place. Pin 30 prevents the pivoting movement from going too far.

Even with the two-part adhesive scraper, actuators 6 and 7 are designed as two-stage actuator devices located parallel to one another or one behind the other, as shown in FIGS. 4a–4c. In other words, even with a two piece scraper, two parallel oriented units of actuators may be employed with each actuator unit comprising two or more serially connected piston and cylinder arrangements.

One feature of the invention resides broadly in an adhesive scraper 2 which can be adjusted in a labelling machine in relation to an adhesive roller 19, which is mounted so that it can pivot with a beam 3 on a shaft 1, whereby the beam 3 is spring-loaded in the direction of a stop 13, 14 permanently mounted on the frame and set for the minimum gap width of the adhesive scraper 2 in relation to the adhesive roller 19, and where parallel to this stop 13, 14 there is an additional, adjustable stop 8, 9, 29 permanently fastened to the frame, on which the beam 3 can be supported by means of an actuator 6, 7, 26, 27 with a constant actuator travel, characterized by the fact that the actuator 8, 9, 26, 27 is designed as a multi-stage actuator apparatus.

Another aspect of the invention resides broadly in an adhesive scraper characterized by the fact that the actuator is a cylinder-piston unit with actuator cylinders 26, 27 connected in series.

Yet another feature of the invention, resides broadly in an adhesive scraper, characterized by the fact that of the actuator cylinders 26, 27, one actuator cylinder 27 with its piston rod 27''' acts on the piston 26'' of another actuator cylinder 26, which has a longer stroke than the first actuator cylinder 27.

A further aspect of the invention resides broadly in an adhesive scraper, characterized by the fact that the actuator apparatus 2 comprises actuator cylinders 6, 7 oriented parallel to one another.

A yet further aspect of the invention resides broadly in an adhesive scraper, characterized by the fact that the actuator cylinders 6, 7 oriented parallel to one another have strokes of different lengths.

An additional aspect of the invention resides broadly in an adhesive scraper, characterized by the fact that the adhesive scraper 2 is designed in two parts, and its two parts are mounted each with its own beam 4, 5 on the shaft 1 above one another so that they can be pivoted, and that the two beams 4, 5 are coupled to one another by means of a single thrust slaving device 21–23 so that when one actuator 6, 7 is activated, the beam 3a, 4a corresponding to this actuator 6, 7 drives the other one.

A yet additional aspect of the invention resides broadly in an adhesive scraper, characterized by the fact that the slaving apparatus 21–23 consists of a driver 21 supported on the beam 3a and of an abutment 22 supported by the other beam 3b.

A further additional aspect of the invention resides broadly in an adhesive scraper, characterized by the fact that the slaving apparatus 21–23 has an adjustable idle stroke.

Another further additional aspect of the invention resides broadly in an adhesive scraper, characterized by the fact that the two beams 3a, 3b are coupled to one another by means of a double thrust slaving apparatus 24, 25 with an idle stroke such that the slaving apparatus 24, 25 does not respond in the adjustment range of the actuators 6, 7.

A still further aspect of the invention resides broadly in an adhesive scraper characterized by the fact that the adhesive scraper is designed in two parts, and its two parts are mounted, each on its own beam 3a, 3b on the shaft 1 above one another, so that they can pivot, and that the two beams 3a, 3b are coupled to one another by means of a double thrust slaving device 24, 25, so that the slaving apparatus 24, 25 responds only in a portion of the adjustment range of the actuators 6, 7.

Another still further additional aspect of the invention resides broadly in an adhesive scraper, characterized by the fact that the spring loading of each beam 3a, 3b of an adhesive scraper part is produced by a spring-like thrust piece 18, 19 acting on a wedge surface.

Examples of labelling machines may be found in U.S. Pat. No. 4,944,830 entitled "Machine For Labelling Bottles"; U.S. Pat. No. 4,911,285 entitled "Drive For A Rotary Plate In A Labelling Machine For Bottles"; U.S. Pat. No. 4,976,803 entitled "Apparatus For Pressing Foil On Containers, Such As On The Tops And The Necks Of Bottles Or The Like"; U.S. Pat. No. 4,950,350 entitled "Machine For Labelling Bottles"; U.S. Pat. No. 5,017,261 entitled "Labelling Machines For Objects Such As Bottles Or The Like"; U.S. Pat. No. 4,981,547 entitled "Mounting And Drive Coupling For The Extracting Element Support Of A Labelling Station For A Labelling Machine For Containers And Similar Objects"; and U.S. Pat. No. 4,298,422 entitled "Labelling Machine".

Additional examples of labelling machines may be found in U.S. patent application Ser. No. 07/335,025 entitled "Support Element For The Followers Of A Cam Drive Of A Drive Mechanism And A Labelling Station Equipped With A Support Element"; U.S. patent application Ser. No. 07/335,478 entitled "Labelling Machine For Objects Such As Bottles Or The Like"; U.S. patent application Ser. No. 07/431,587 entitled "Labelling Machine For The Labelling Of Containers"; U.S. patent application Ser. No. 07/432,113 entitled "Glue Segments Which Can Be Attachable To A Drive Shaft Of A Labelling Machine"; U.S. patent application Ser. No. 07/550,321 entitled "Labelling Machine For The Labelling Of Containers"; U.S. patent application Ser. No. 07/593,226 entitled "Bottle Labelling Machine"; U.S. patent application Ser. No. 07/595,453 entitled "Brushing Station For A Labelling Machine For Labelling Bottles And The Like"; and U.S. patent application Ser. No. 07/668,301 entitled "Apparatus And Related Method For The Removal Of Labels And Foil Tags Adhering To Containers, In Particular, To Bottles."

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings in their entirety, including all dimensions, proportions and/or shapes in at least one embodiment of the invention, are accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. A labelling machine comprising:

a labelling station;

means for supplying labels to said labelling station;

mean for supplying objects to be labelled to said labelling station;

said labelling station having an adhesive application roller;

means for supplying adhesive to said adhesive application roller; and means for variably adjusting a thickness of adhesive on said adhesive application roller;

said means for variably adjusting a thickness of adhesive on said adhesive application roller comprising:

blade means for adjusting the thickness of adhesive on the adhesive application roller;

said blade means comprising a thickness forming edge disposed in an adjacent but noncontacting disposition with respect to said adhesive application roller;

automatically actuated positioning means for moving said thickness forming edge of said blade means between a plurality of discrete noncontacting positions adjacent the adhesive application roller;

control means for positioning said thickness forming edge of said blade means at a selected one of said plurality of discrete noncontacting positions adjacent said adhesive application roller;

said thickness forming edge of said blade means and said adhesive application roller to define a gap therebetween at each said position of said blade means;

said blade means being configured to form a thickness of adhesive on the adhesive application roller corresponding to each said gap; and each thickness of adhesive corresponding to each said gap being different from each other thickness of adhesive corresponding to each other said gap.

2. The labelling machine of claim 1, wherein:

said positioning means comprises a first piston and cylinder means, a second piston and cylinder means and a third piston and cylinder means for moving said blade means;

said first and second piston and cylinder means are connected to one another in series;

said blade means is movable by said first piston and cylinder means from a first position to a second position;

said second piston and cylinder means is movable to contact said first piston and cylinder means to move said blade means from said second position to a third position;

said blade means comprises first and second blade parts;

said first blade part is movable between at least two of said plurality of positions by said first and second piston and cylinder means; and said second blade part is movable between at least two of said plurality of positions by said third piston and cylinder means.

3. Apparatus for variably adjusting a thickness of adhesive on an adhesive application roller of a labelling machine, said apparatus comprising:

blade means for adjusting the thickness of an adhesive on the adhesive application roller;

positioning means for moving said blade means between at least three rigidly maintained, discrete and reproducable positions adjacent the adhesive application roller;

said blade means and the adhesive application roller to define a gap therebetween at each said position of said blade means;

said blade means being configured to form a thickness of adhesive on the adhesive application roller corresponding to each said gap; and each thickness of adhesive corresponding to each said gap being different from each other thickness of adhesive corresponding to each other said gap.

4. The apparatus of claim 3, wherein said positioning means comprises first piston and cylinder means and second piston and cylinder means.

5. The apparatus of claim 4, wherein:

said first and second piston and cylinder means connected to one another in series;

said blade means is movable by said first piston and cylinder means from a first position to a second position; and said second piston and cylinder means is movable to contact said first piston and cylinder means to move said blade means from said second position to a third position.

6. The labelling machine of claim 4, wherein:

said first and second piston and cylinder means are in parallel orientation with respect to one another;

said blade means is movable by said first piston and cylinder means from a first position to a second position;

said blade means is movable by said second piston and cylinder means from one of said first and second positions to a third position; and said first piston and cylinder means is out of contact with said second piston and cylinder means.

7. The labelling machine of claim 6, wherein:

said first piston and cylinder means comprises a plurality of pistons and cooperating cylinders connecected to one another in series; and said second piston and cylinder means comprises a plurality of pistons and cooperating cylinders connected to one another in series.

8. The labelling machine of claim 6, wherein:

said blade means comprises first and second blade parts;

said first blade part is movable between two of said at least three positions by said first piston and cylinder means; and said second blade part is movable between two of said at least three positions by said second piston and cylinder means.

9. The labelling machine of claim 8, wherein said first blade part is configured to move said second blade part when said first blade part moves from said first position to said second position.

10. The labelling machine of claim 8, further including:

said positioning means being an actuator;

said actuator being a cylinder-piston unit with actuator cylinders connected in series;

one said actuator cylinder having a piston rod acting on the piston of another said actuator cylinder which has a longer stroke than said one said actuator cylinder;

actuator apparatus comprising actuator cylinders oriented parallel to another;

said actuator cylinders oriented parallel to one another having strokes of different lengths;

said blade means being an adhesive scraper;

said adhesive scraper being designed in two parts, said two parts being mounted, each with its own beam, on a shaft above one another such that they can be pivoted, and wherein said beams are coupled to one another by means of a single thrust slaving device, whereby, when one said actuator is activated, the beam corresponding to said actuator drives the other one;

said slaving apparatus comprising a driver supported on one said beam and on an abutment supported by the other said beam;

said slaving apparatus having an adjustable idle stroke;

said beams being coupled to one another by means of a double thrust slaving apparatus with an idle stroke such that the said slaving apparatus does not respond in the adjustment range of the actuators; and said beams being spring loaded wherein said beams are produced by a spring-thrust piece acting on a wedge surface.

11. Apparatus for variably adjusting the thickness of adhesive on an adhesive application roller of a labelling machine, said machine comprising:

means for adjusting the thickness of adhesive on the adhesive application roller;

means for automatically and selectively controlling said means for adjusting the thickness of adhesive on the adhesive application roller to at least three rigidly maintained, discrete and reproducable positions adjacent the adhesive application roller;

said means for adjusting the thickness of adhesive on the adhesive application roller and the adhesive application roller defining a gap therebetween at each of said at least three rigidly maintained discrete and reproducable positions of said means for controlling the thickness of adhesive on the adhesive application roller;

said means for adjusting the thickness of adhesive on the adhesive application roller being configured to form a thickness of adhesive on the adhesive application roller corresponding to each said gap; and each thickness of adhesive corresponding to each said gap being different from each other thickness of adhesive corresponding to each other said gap.

12. The apparatus of claim 11, wherein said means for automatically and selectively controlling said means for adjusting the thickness of adhesive on the adhesive application roller comprises first and second piston and cylinder means for moving said means for adjusting the thickness of adhesive on the adhesive application roller.

13. The apparatus of claim 12, wherein:

said first and second piston and cylinder means are connected to one another in series;

said means for adjusting the thickness of adhesive on the adhesive application roller is movable by said first piston and cylinder means from a first position to a second position; and said second piston and cylinder means is movable to contact said first piston and cylinder means to move said means for adjusting the thickness of adhesive on the adhesive application roller from said second position to a third position.

14. The apparatus of claim 12, wherein:

said first and second piston and cylinder means are in parallel orientation with respect to one another;

said means for adjusting the thickness of adhesive on the adhesive application roller is movable by said first piston and cylinder means from a first position to a second position;

said means for adjusting the thickness of adhesive on the adhesive application roller is movable by said second piston and cylinder means from one of said first and second positions to a third position; and said first piston and cylinder means is out of contact with said second piston and cylinder means.

15. The apparatus of claim 14, wherein:

said first piston and cylinder means comprises a plurality of pistons and cooperating cylinders connected to one another in series; and said second piston and cylinder means comprises a plurality of pistons and cooperating cylinders connected to one another in series.

16. The apparatus of claim 14, wherein:

said means for adjusting the thickness of adhesive on the adhesive application roller comprises first and second blade parts;

said first blade part is movable between at least two of said plurality of positions by said first piston and cylinder means; and said second blade part is movable between least two of said plurality of said positions by said second piston and cylinder means.

17. The apparatus of claim 16, wherein said first blade part is configured to move said second blade part when said first blade part moves from said first position to said second position.

18. The apparatus of claim 17, wherein said second blade part is configured to move said first blade part when said second blade part moves from said first position to said third position.

19. The apparatus of claim 16, wherein:

said first piston and cylinder means comprises a plurality of pistons and cooperating cylinders connected to one another in series; and said second piston and cylinder means comprises a plurality of pistons and cooperating cylinders connected to one another in series.

20. The apparatus of claim 19, further including:

said means for adjusting the thickness of adhesive on the adhesive application roller being movable by an actuator;

said actuator being a cylinder-piston unit with actuator cylinders connected in a series;

one said actuator cylinder having a piston rod acting on the piston of another said actuator cylinder which has a longer stroke than said one said actuator cylinder;

actuator apparatus comprising actuator cylinders oriented parallel to one another;

said actuator cylinders oriented parallel to one another having strokes of different lengths;

said means for adjusting the thickness of adhesive on the adhesive application roller being an adhesive scraper;

said adhesive scraper being designed in two parts, said two two parts being mounted, each with its own beam, on a shaft above one another such that they can be pivoted, and wherein said beams are coupled to one another by means of a single thrust slaving device, whereby, when one said actuator is activated, the beam corresponding to said actuator drives the other one;

said slaving apparatus comprising a driver supported on one said beam and on an abutment supported by the other said beam;

said slaving apparatus having an adjustable idle stroke;

said beams being coupled to one another by means of a double thrust slaving apparatus with an idle stroke such that the said slaving apparatus does not respond in the adjustment range of the actuators; and said beams being spring loaded wherein said beams are produced by a spring-thrust piece acting on a wedge surface.

* * * * *